US008755707B2

(12) United States Patent
Yasuda et al.

(10) Patent No.: US 8,755,707 B2
(45) Date of Patent: Jun. 17, 2014

(54) IMAGE FORMING DEVICE HAVING FUNCTION FOR CONTROLLING TEMPERATURE OF HEATING MEMBER

(75) Inventors: Masaki Yasuda, Nagoya (JP); Fumitake Tajiri, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 276 days.

(21) Appl. No.: 12/648,560

(22) Filed: Dec. 29, 2009

(65) Prior Publication Data

US 2010/0196037 A1 Aug. 5, 2010

(30) Foreign Application Priority Data

Feb. 4, 2009 (JP) ..... 2009-023235

(51) Int. Cl.
*G03G 15/20* (2006.01)

(52) U.S. Cl.
USPC ..... 399/70; 399/44; 399/69

(58) Field of Classification Search
USPC ..... 399/69, 70, 44
See application file for complete search history.

(56) References Cited

U.S. PATENT DOCUMENTS 6,964,515 B2 * 11/2005 Asakura et al.
2005/0163524 A1 * 7/2005 Shiobara et al. ..... 399/69
2005/0207774 A1 * 9/2005 Sone et al. ..... 399/69
2007/0140719 A1 * 6/2007 Sato ..... 399/69
2008/0069581 A1 3/2008 Otsuka
2009/0208237 A1 * 8/2009 Yasuda ..... 399/69
2010/0129106 A1 * 5/2010 Tajiri et al. ..... 399/70

FOREIGN PATENT DOCUMENTS

JP 2000-039800 2/2000
JP 2003-065853 3/2003
JP 2006-337488 A 12/2006
JP 2007-047126 A 2/2007
JP 2007-163884 6/2007
JP 2008-076635 A 4/2008

OTHER PUBLICATIONS

JP Office Action dtd Jan. 18, 2011, JP Appln. 2009-023235, English Translation.

* cited by examiner

*Primary Examiner* — Walter L Lindsay, Jr.
*Assistant Examiner* — Milton Gonzales
(74) *Attorney, Agent, or Firm* — Banner & Witcoff, Ltd.

(57) ABSTRACT

An image forming device has a heating member, a thermal detecting unit, and a control unit. The heating member is positioned at an ambient temperature and heated by a heat source. The heating member fixes a developed image to a recording sheet. The thermal detecting unit is provided separately from the heating member. The thermal detecting unit detects a first temperature. The control unit uses a function to calculate a second temperature of the heating member on the basis of the detected first temperature. The control unit controls the heat source on the basis of the second temperature. The function has a rate of change that increases with decreasing the ambient temperature.

6 Claims, 3 Drawing Sheets

IMAGE FORMING DEVICE HAVING FUNCTION FOR CONTROLLING TEMPERATURE OF HEATING MEMBER

CROSS REFERENCE TO RELATED APPLICATION

This application claims priority from Japanese Patent Application No. 2009-023235 filed Feb. 4, 2009. The entire content of this priority application is incorporated herein by reference.

TECHNICAL FIELD

The present invention relates to an image forming device provided with a thermal detector for detecting a temperature of a heating member which is used to fix a developed image onto a recording sheet.

BACKGROUND

A well-known conventional image forming device has a heating roller heated by a heat source, a noncontact thermistor located separately from the heating roller for detecting a temperature of the heating roller, and a control unit for controlling the heat source, based on the detected temperature by the thermistor.

SUMMARY

The noncontact thermistor is susceptible to various conditions related to the image forming device, so that the detected temperature by the noncontact thermistor often needs the correction thereof. Especially, during a warming up period in which the heating roller is heated to a target temperature after a power supply is started, the temperature of the heating roller rises up so quickly, and the ambient temperature of the heating roller does not follow the temperature of the heating roller quickly. Accordingly, the detected temperature of the heating roller by the noncontact thermistor does not follow an actual temperature of the heating roller immediately.

In the above case, when the ambient temperature is relatively lower at the start of warming up the heating roller, and the actual temperature of the heating roller reaches the target temperature, a great difference between the actual temperature and the detected temperature of the heating roller may occur. On the other hand, when the ambient temperature is relatively higher at the start of warming up the heating roller, and the actual temperature of the heating roller has reached the target temperature, the difference between the actual temperature and the detected temperature of the heating roller is smaller, compared with the case where the ambient temperature is relatively lower at the start of warming up the heating roller.

Suppose that the function having a larger rate of change is used as a correction formula for correcting the detected temperature of the noncontact thermistor because of the lower ambient temperature at the start of warming up the heating roller. The temperature of the heating roller calculated from the ambient temperature may happen to reach the target temperature quicker than the actual temperature of the heating roller. This fact sometimes leads to affect a precise control for the temperature of the heating roller.

An object of the invention is to provide an image forming device which corrects detected value by a thermal detecting unit in a proper manner to control a heating roller with high precision.

The present invention features an image forming device having a heating member, a thermal detecting unit, and a control unit. The heating member is positioned at an ambient temperature and heated by a heat source. The heating member fixes a developed image to a recording sheet. The thermal detecting unit is provided separately from the heating member. The thermal detecting unit detects a first temperature of the heating member. The control unit uses a function to calculate a second temperature of the heating member on the basis of the detected first temperature. The control unit controls the heat source on the basis of the second temperature. The function has a rate of change that increases with decreasing the ambient temperature.

The present invention features an image forming device having a heat source, a heating member, and thermal detecting unit, and a control unit. The heat source generates a predetermined amount of heat per unit time. The heating member is positioned at an ambient temperature and heated by the heat source. The heating member fixes a developed image to a recording sheet. The thermal detecting unit is provided separately from the heating member. The thermal detecting unit detects a first temperature of the heating member. The control unit uses a function to calculate a second temperature of the heating member on the basis of the detected first temperature. The control unit controls the heat source on the basis of the second temperature. The function having a rate of change that increases with increasing the predetermined amount of heat per unit time generated from the heat source.

An image forming device has a heating member, a thermal detecting unit, and a control unit. The heating member is positioned at an ambient temperature and heated by a heat source. The heating member fixes a developed image to a recording sheet. The thermal detecting unit is provided separately from the heating member. The thermal detecting unit detects a first temperature of the heating member. The control unit uses a function to calculate a second temperature of the heating member on the basis of the detected first temperature. The function has a rate of change. The control unit controls the heat source on the basis of the second temperature. The controller includes a first determination unit, a first setting unit, a second determination unit, a second setting unit, and a third setting unit. The first determination unit determines whether the detected first temperature is less than or equal to a first predetermined temperature. The first setting unit sets the rate of change to a first value if the first determination unit determines that the detected first temperature is less than or equal to the first predetermined temperature. The second determination unit determines whether the detected first temperature is less than or equal to a second predetermined temperature which is higher than the first predetermined temperature. The second setting unit sets the rate of change to a second value if the second determination unit determines that the detected first temperature is less than or equal to the second predetermined temperature, the second value being less than the first value. The third setting unit sets the rate of change to a third value if the second determination unit determines that the detected first temperature is more than the second predetermined temperature, the third value being less than the second value.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
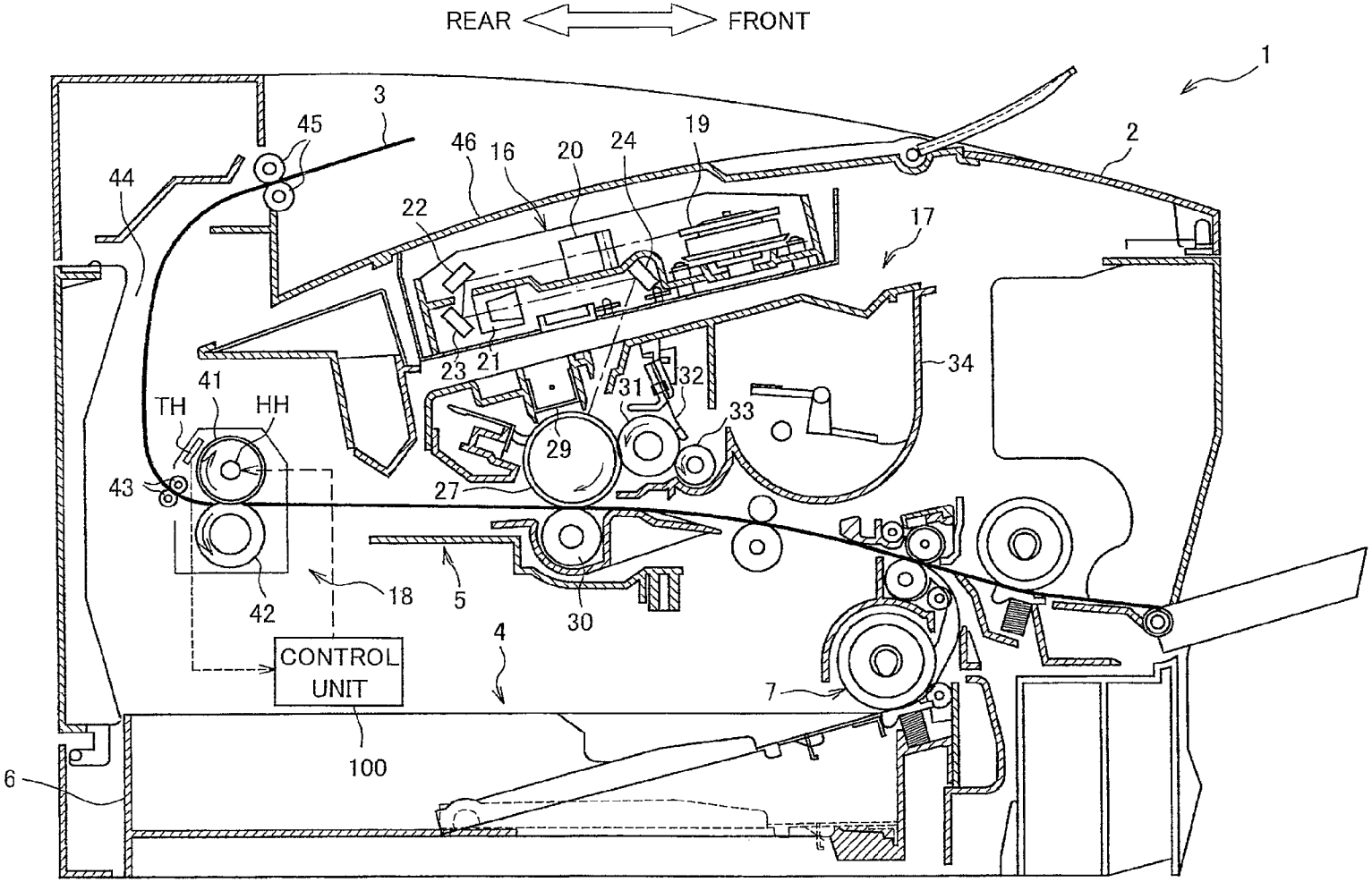
FIG. 1 is a vertical sectional view showing a laser printer according to an embodiment of the present invention.

An image forming device according to embodiments of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming is disposed in an orientation in which it is intended to be used, without any specific restriction.

General Structure of Laser Printer

FIG. 1 shows a laser printer 1 having a feeder unit 4 for feeding a sheet 3 and an image forming unit 5 for forming an image on the sheet 3 fed by the feeder unit 4 in a main casing 2.

The feeder unit 4 includes a paper tray 6 and a sheet feeding mechanism 7. The paper tray 6 is loadable in the bottom part of the main casing 2. The sheet feeding mechanism 7 feeds the sheet 3 from the paper tray 6 to the image forming unit 5. In the feeder unit 4, the sheet 3 in the paper tray 6 is fed by the sheet feeding mechanism 7 one sheet at a time.

The image forming unit 5 includes an optical scanning unit 16, a processing cartridge 17, and a fixing unit 18.

The optical scanning unit 16 is provided in the upper portion of the main casing 2, and includes a laser generator (not shown), a rotatable polygon mirror 19, lenses 20 and 21, and reflecting mirrors 22, 23, and 24. In the optical scanning unit 16, a laser beam emitted from the laser generator travels to a surface of a photosensitive drum 27 in the processing cartridge 17 and scans image thereon at a high speed.

The processing cartridge 17 is positioned under the optical scanning unit 16 and detachable with respect to the main casing 2. The processing cartridge 17 includes the photosensitive drum 27, a charger 29, a transfer roller 30, a developing roller 31, a thickness-regulating blade 32, a supply roller 33, and toner hopper 34.

In the processing cartridge 17, the laser beam from the optical scanning unit 16 exposes the surface of the photosensitive drum 27 charged by the charger 29 to form an electrostatic latent image thereon. Toner in the toner hopper 34 is supplied to the supply roller 33 and the developing roller 31 to form a developed image on the photosensitive drum 27. Next, when the sheet 3 is transferred between the photosensitive drum 27 and the transfer roller 30, a toner image on the photosensitive drum 27 is attracted toward the transfer roller 30 and then transferred to the sheet 3.

Structure of Fixing Unit

The fixing unit 18 includes a halogen heater HH as a heat source, a cylindrical heating roller 41 as a heating member, a pressure roller 42, and a thermistor TH as a thermal detector for detecting a temperature of the heating roller 41.

The halogen heater HH is provided in the heating roller 41 and heats the heating roller 41 from the inside thereof. The halogen heater HH is controlled by a control unit 100 described later.

The heating roller 41 has a cylindrical shape made from a metallic material, and is rotatably supported to the main casing 2. The heating roller 41 is rotated with a driving force applied from a driving unit (not shown) which is driven by a control signal from the control unit 100. In this embodiment, the heating roller 41 has a cylindrical surface made from aluminum and coated with polytetrafluoroethylene (PTFE) such as TEFLON (registered trademark).

The pressure roller 42 is pressed to the heating roller 41 with a spring (not shown) to contact with the heating roller 41 and follow the rotation of the heating roller 41. In this embodiment, the pressure roller 42 is formed by surrounding a core with silicon rubber and covering a surface of silicon rubber with a TEFLON (registered trademark) tube.

The thermistor TH is positioned separately from and at a predetermined distance from the heating roller 41 to detect a temperature of the heating roller 41. The detected temperature by the thermistor TH is sent to the control unit 100.

In the fixing unit 18 configured above, the halogen heater HH heats the heating roller 41. The toner image which has been transferred on the sheet 3 is thermally fixed on the sheet 3 while passing between the heating roller 41 and the pressure roller 42. Then, the sheet 3 is transferred into a discharging path 44 by a transfer roller 43. The sheet 3 transferred in the discharging path 44 is discharged onto a discharging tray 46 by a discharging roller 45.

Structure for Supporting Thermistor

Figure 2:
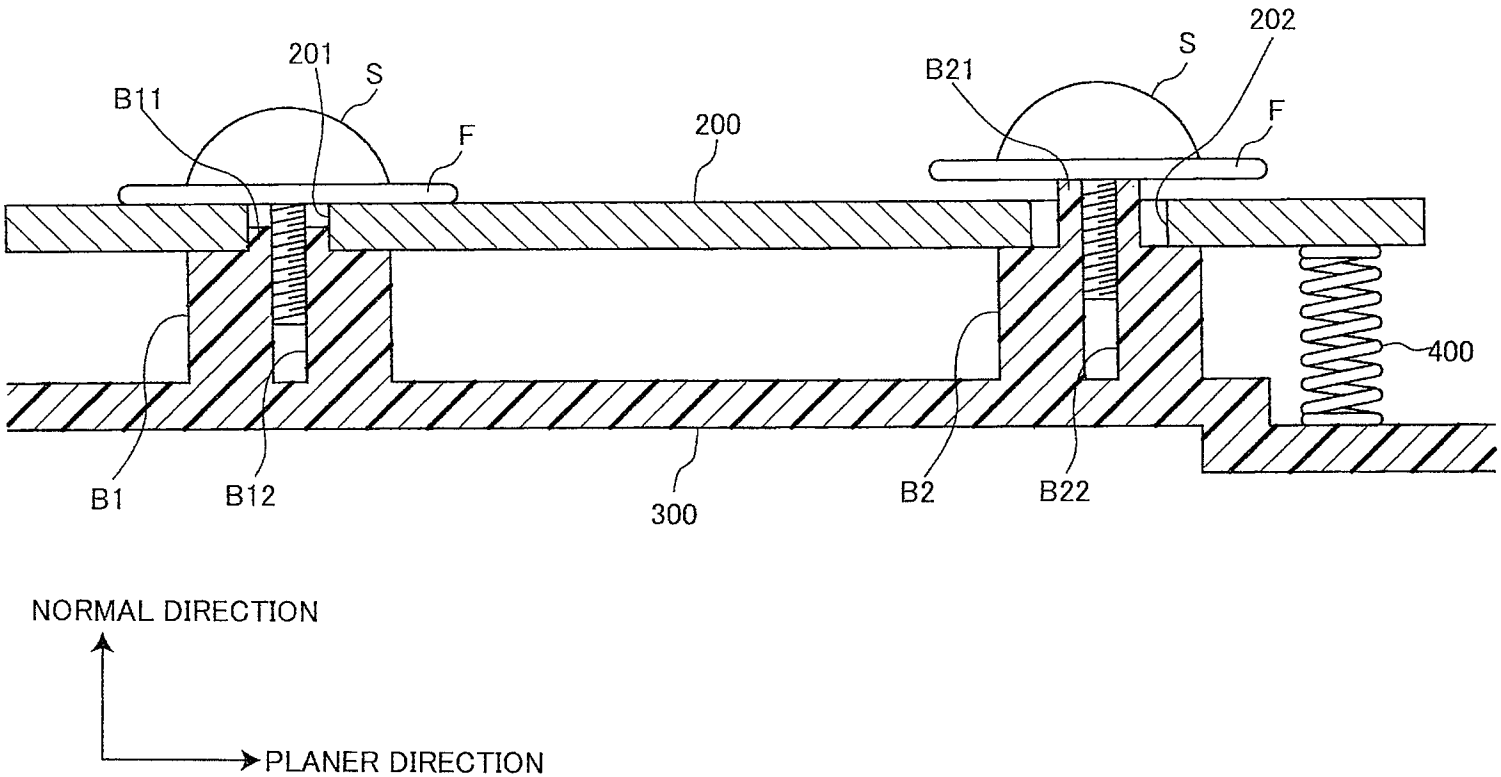
FIG. 2 is a sectional view showing a detailed structure for supporting a thermistor by a metal plate.

The structure for supporting the thermistor TH in the fixing unit 18 will be described, referring to FIG. 2. The thermistor TH is preferably supported by a metal plate 200 attached to a resinous frame 300 fixed to the fixing unit 18. In FIG. 2, directional terms will be described with reference to a section of the resinous frame 300. Specifically, the metal plate 200 includes a positioning hole 201 configured to fit a first protrusion B11 formed on an end face of a first boss B1 projecting from the frame 300, and a loose fitting hole 202 such as a long hole or a large diameter hole loosely configured to fit a second protrusion B21 formed on an end face of a second boss B2 standing from the frame 300. Additionally, the positioning hole 201 is arranged at one of the plurality of fastening portions of the metal plate 200. The respective loose fitting holes 202 are arranged at the rest of the plurality of fastening portions. In this embodiment, the metal plate 200 has four fastening portions.

On the other hand, the first and second bosses B1 and B2 formed on the frame 300 are formed in a cylindrical shape, and have the same diameter and height. The first protrusion B11 formed on the end face of the first boss B1 has a height not projecting from the metal plate 200 placed on the end face of the first boss B1, while the second protrusion B21 formed on the end face of the second boss B2 has a height projecting from the metal plate 200 placed on the end face of the second boss B2.

Additionally, a protrusion length of the second protrusion B21 from the metal plate 200 is set to about 0.05 to 0.1 mm. Threaded holes B12 and B22, respectively, are formed for screwing a screw S having a flange F at centers of the first boss B1 and the first protrusion B11, and of the second boss B2 and the second protrusion B21.

When the metal plate 200 is fastened by the screw S to each of the bosses B1 and B2, the first protrusion B11 of the first boss B1 is fit in the positioning hole 201 to thereby position the metal plate 200 in the planer direction of the frame 300. Additionally, the metal plate 200 is held by and between the flange F of the screw S and the end face of the first boss B1 to be thereby positioned in normal direction of the frame 300. On the other hand, the second protrusion B21 of the second boss B2 is loosely fitted in the loose fitting hole 202, and the screw S is fixed on the tip of the second protrusion B21.

Thereby, a gap G having a length h of about 0.05 to 0.1 mm is formed between the flange F of the screw S and the metal plate 200.

Accordingly, a portion around the loose fitting hole 202 of the metal plate 200 is not pressed to the second boss B2 by the flange F of the screw S, which allows the metal plate 200 to play in the planer direction of the frame 300. Therefore, even when the difference in linear expansion coefficients between the metal plate 200 and the resinous frame 300 causes expansion and contraction of the metal plate 200 in the planer direction of the frame 300, the expansion and contraction of the metal plate 200 are absorbed by the loose fitting hole 202.

Meanwhile, since the gap G is provided between the flange F of the screw S and the metal plate 200 in order to allow the expansion and contraction of the metal plate 200, this portion of the metal plate 200 is unstable in the normal direction of the frame 300. Therefore, in order to reduce this instability, a coil spring 400 as an urging member is provided between the metal plate 200 and the frame 300, and presses the portion around the loose fitting hole 202 of the metal plate 200 to the flange F of the screw S. Additionally, an urging force of the coil spring 400 may be set to such a level that this instability can be reduced and the movement of the metal plate 200 due to the expansion and contraction thereof between the flange F and the boss B2 in the planer direction can be allowed.

Structure and Operation of Control Unit

Next, the control unit 100 will be described. The control unit 100 includes known hardware such as a CPU, ROM, RAM, communication device, or the like, mainly calculates a temperature of the heating roller 41 from the temperature detected by the thermistor TH (hereinafter referred to as "detected temperature") through a predetermined function, and controls the halogen heater HH on the basis of the calculated temperature (hereinafter referred to as "calculated temperature").

Additionally, the control unit 100 is configured to use the function having a ratio of change increasing when the ambient temperature of the heating roller 41 at the start of a warm up decreases. Now, the "warm up" means a control for rapidly raising the temperature of the heating roller 41 to a target temperature from the start of power-on or from a ready mode which is a control for maintaining the temperature of the heating roller 41 at a predetermined temperature lower than the target temperature suitable for the heating.

Additionally, the "ambient temperature of the heating roller 41" can be given by employing the temperature detected by the thermistor TH, the temperature estimated on the basis of the temperature detected by the thermistor TH before the start of the warm up and the elapsed time from the start of the detection of the detected temperature, the temperature estimated on the basis of the temperature of the heating roller 41 (calculated temperature) right after the end of printing and elapsed time from the end of the printing, or the like. Meanwhile, in this embodiment, the temperature detected by the thermistor TH is employed as the "ambient temperature of the heating roller 41".

Additionally, the "ratio of change" means a ratio of change in the calculated temperature to change in the detected temperature, in other words, a differential coefficient, and corresponds to a differential coefficient of when variables are set under the same condition in the case where the function is a second-order or higher continuous function.

Therefore, for example, when the functions are the following functions:

$$y=x^2, y=2x^2$$

which are second-order functions, their respective differential coefficients:

$$dy/dx=2a, dy/dx=4a$$

are obtained under the same condition (x=a), resulting in the function "$y=2x^2$" having a higher ratio of change (larger slope).

In this embodiment, the control unit 100 uses an expression (1):

$$y=Ax+B \quad (1)$$

of a first-order function as the above-described predetermined function where y is the calculated temperature, A is a correction coefficient (ratio of change), x is the detected temperature, and B is a constant.

The control unit 100 changes the correction coefficient A in the expression (1) on the basis of the detected temperature (ambient temperature of the heating roller 41) at the start of the warm up. Specifically, the control unit 100 changes the correction coefficient A according to a flowchart described below.

Figure 3:
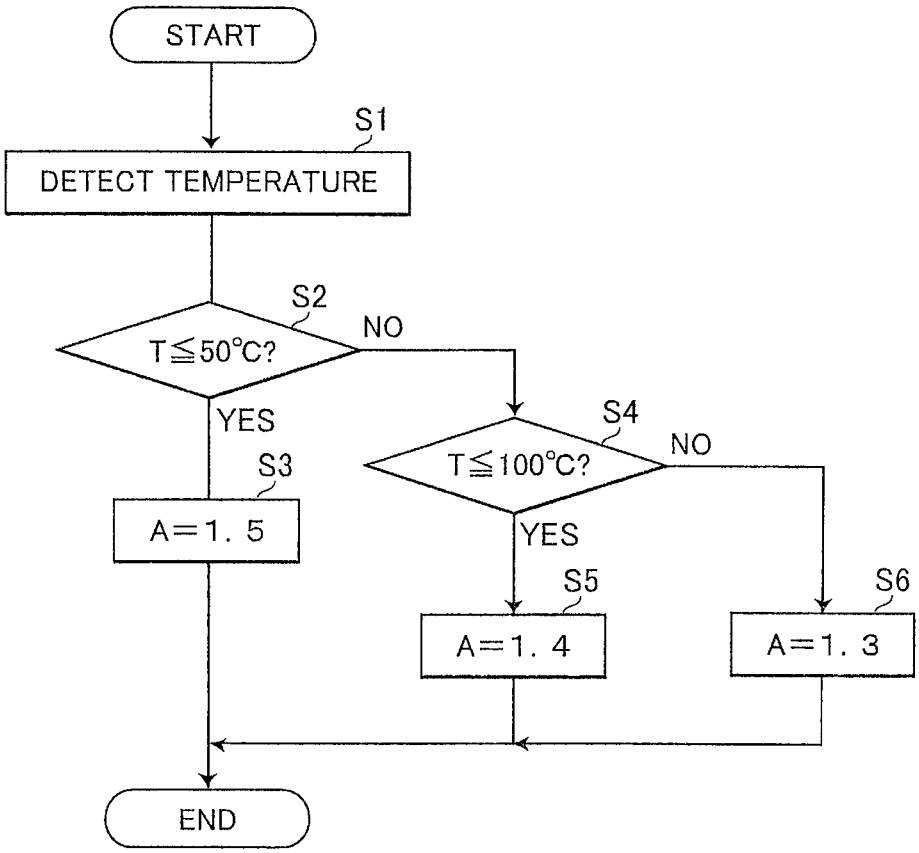
FIG. 3 is a flowchart illustrating a procedure by a control unit.

As shown in FIG. 3, the control unit 100 starts the warm up of the heating roller 41 when a predetermined condition is satisfied (power-on, instructing for printing during the ready mode, or the like) (START), and then receives an output from the thermistor TH. The control unit 100 treats the detected temperature of the thermistor TH as the ambient temperature of the heating roller 41 in the step S1. Next, the control unit 100 determines whether or not the temperature detected by the thermistor TH (detected temperature T) is equal to or lower than 50° C. at the step S2.

In the step S2, when the detected temperature T is equal to or lower than 50° C. (S2:Yes), the control unit 100 sets the correction coefficient A to "1.5" in the step S3 to finish the procedure.

Additionally, in the step S2, when the detected temperature T exceeds 50° C. (S2:No), the control unit 100 determines whether or not the detected temperature T is equal to or lower than 100° C. at the step S4. Then, in the step S4, when the detected temperature T is equal to or lower than 100° C. (S4:Yes), the control unit 100 sets the correction coefficient A to a value of "1.4" smaller than that of "1.5" at the step S5 to finish the procedure.

Additionally, in the step S4, when the detected temperature T exceeds 100° C. (S4:No), the control unit 100 sets the correction coefficient A to a value of "1.3" smaller than that of "1.4" at the step S6 to finish the procedure.

After finishing the procedure shown in FIG. 3, the control unit 100 substitutes the set correction coefficient A into the expression (1) to calculate the temperature of the heating roller 41. Accordingly, in the case of the low ambient temperature of the heating roller 41 at the start of the warm up (for example, 50° C.), even if the difference between the actual temperature of the heating roller 41 and the ambient temperature (detected temperature) increases when the actual temperature of the heating roller 41 reaches the target temperature, the detected temperature is significantly corrected by the function (1) having the larger correction coefficient A to thereby calculate the more accurate temperature. Thus, the calculated temperature can substantially become equal to the actual temperature of the heating roller 41.

Additionally, in the case of the high ambient temperature of the heating roller 41 at the start of the warm up (for example 100° C.), even if the difference between the actual temperature of the heating roller 41 and the ambient temperature (detected temperature) is smaller when the actual temperature of the heating roller 41 reaches the target temperature, the detected temperature is slightly corrected by the function (1) having the smaller correction coefficient A to thereby calculate the more accurate temperature. Accordingly, the calculated temperature can substantially become equal to the actual temperature of the heating roller 41. Therefore, for any ambient temperature of the heating roller 41 at the start of the warm up, when the calculated temperature reaches the target temperature, the temperature of the heating roller 41 can be correctly determined to reach the target temperature.

According to the above-described embodiment, the following advantageous effects can be provided.

The more the ambient temperature of the heating roller 41 decreases at the start of the warm up, the higher ratio of the change the function is used. Thus, the temperature detected by the thermistor TH can be appropriately corrected to control the temperature with higher accuracy.

The temperature detected by the thermistor TH is used as the "ambient temperature of the heating roller 41" functioning as a reference value for changing the correction coefficient A. Accordingly, the ambient temperature can be readily detected without a complicated control.

Meanwhile, the present invention is not restricted by the above-described embodiment, but can be used in exemplary various forms as described below.

In the above-described embodiment, the lower the ambient temperature of the heating roller 41 at the start of the warm up, the higher ratio of the change the function is used. However, the present invention is not restricted by this example. For example, the function is defined at the start of the warm up similarly to the above-described embodiment, and then the function having a higher ratio of change (larger slope) may be used in a mode in which an amount of heat per unit time generated from the heat source increases. Specifically, for example, in a form of a control in which the heat source is repeatedly powered on and off, the actual number of times of power-on in a fixed period is divided by the maximum number of times capable of powering on the heat source in the fixed period to thereby calculate a duty ratio. Then, the more the duty ratio increases, the higher ratio of the change the employed function may use.

In the above-described embodiment, the function used to calculate the actual temperature of the heating roller 41 has the rate of change which is changed when the ambient temperature at the start of warming up the heating roller 41 is 50° C. or 100° C. However, the reference temperature to switch the rate of change is not restricted to the above, but any reference temperature to switch the rate of change can be used.

In the above-described embodiment, the halogen heater HH is employed as the heat source, but the present invention is not restricted by this example. For example, an induction heater or a heating resistor may be employed.

In the above-described embodiment, the heating roller 41 is employed as the heating member, but the present invention is not restricted by this example. For example, a cylindrical fixing film slidably supported by a guide may be employed.

The "temperature" is based on the unit of ° C. by way of example. However, in the present invention, a value such as a resistance value or a voltage value of a resistive element for detecting temperature in the thermistor TH can be employed as the value indicating the "temperature". Additionally, any data appropriately converted from temperature based on the unit of ° C. can be employed as the "temperature".

In the above-described embodiment, the present invention is applied to the laser printer 1, but the present invention is not restricted by this example. The present invention may also be applied to other image forming apparatuses such as a copier or a multi-function device.

In the above-described embodiment, the sheet 3 such as cardboard, a postcard, or thin paper is employed as the exemplary recording sheet, but the present invention is not restricted by this. For example, an OHP sheet may also be employed.

While the invention has been described in detail with reference to the embodiments thereof, it would be apparent to those skilled in the art that various changes and modifications may be made therein without departing from the spirit of the invention.

What is claimed is:

1. An image forming device, comprising:

a heating member to be heated by a heat source, the heating member being configured to fix a developed image to a recording sheet;

a thermal detecting unit spaced apart from the heating, member, the thermal detecting unit being configured to detect a first temperature of the heating member; and a control unit configured to use a function to calculate a second temperature of the heating member on the basis of the detected first temperature, the control unit being configured to control the heat source on the basis of the second temperature, the function having a rate of change that increases as the first temperature at a start of heating the heating member decreases, wherein the control unit is configured to calculate the second temperature by using the rate of change which is determined based only on the first temperature at the start of heating detected only by the thermal detecting unit spaced apart from the heating member and is configured to calculate the second temperature while maintaining the determined rate of change during warm up of the heating member.

2. The image forming device according to claim 1, wherein the heating member is a rotary heating roller.

3. An image forming device, comprising:

a heat source configured to generate a predetermined amount of heat per unit time;

a heating member to be heated by the heat source, the heating member being configured to fix a developed image to a recording sheet;

a thermal detecting unit spaced apart from the heating member, the thermal detecting unit being configured to detect a first temperature of the heating member; and a control unit configured to use a function to calculate a second temperature of the heating member on the basis of the detected first temperature, the control unit being configured to control the heat source on the basis of the second temperature, the function having a rate of change that increases as the predetermined amount of heat per unit time generated from the heat source at a start of heating the heating member increases, wherein the control unit is configured to calculate the second temperature by using the rate of change which is determined based only on the first temperature at the start of heating detected only by the thermal detecting unit spaced apart from the heating member and is configured to calculate the second temperature while maintaining the determined rate of change during warm up of the heating member.

4. The image forming device according to claim 3, wherein the heating member is a rotary heating roller.

5. An image forming device, comprising:

a heating member to be heated by a heat source, the heating member configured to fix a developed image to a recording sheet;

a thermal detecting unit spaced apart from the heating member, the thermal detecting unit being configured to detect a first temperature of the heating member; and a control unit configured to use a function to calculate a second temperature of the heating member on the basis of the detected first temperature, the function having a rate of change which is determined based only on the first temperature, the control unit being configured to control the heat source on the basis of the second temperature, the control unit configured to function as:

a first determination unit that determines whether the detected first temperature at a start of heating the heating member detected only by the thermal detecting unit spaced apart from the heating member is less than or equal to a first predetermined temperature;

a first setting unit that sets the rate of change to a first value if the first determination unit determines that the detected first temperature at the start of heating the heating member detected only by the thermal detecting unit spaced apart from the heating member is less than or equal to the first predetermined temperature;

a second determination unit that determines whether the detected first temperature at the start of heating the heating member detected only by the thermal detecting unit spaced apart from the heating member is less than or equal to a second predetermined temperature which is higher than the first predetermined temperature;

a second setting unit that sets the rate of change to a second value if the second determination unit determines that the detected first temperature at the start of heating the heating member detected only by the thermal detecting unit spaced apart from the heating member is less than or equal to the second predetermined temperature, the second value being less than the first value; and a third setting unit that sets the rate of change to a third value if the second determination unit determines that the detected first temperature at the start of heating the heating member detected only by the thermal detecting unit spaced apart from the heating member is more than the second predetermined temperature, the third value being less than the second value, wherein the control unit is configured to calculate the second temperature while maintaining, during warm up of the heating member, the rate of change set only by one of the first setting unit, the second setting unit, and the third setting unit.

6. The image forming device according to claim 5, wherein the heating member is a rotary heating roller.

* * * * *